United States Patent [19]

Kumagai et al.

[11] Patent Number: 5,033,440

[45] Date of Patent: Jul. 23, 1991

[54] APPARATUS FOR CONTROLLING AIR/FUEL RATIO OF INTERNAL COMBUSTION ENGINE

[75] Inventors: Shiro Kumagai; Yoshiaki Kodama; Nobuyuki Yasuda, all of Kyoto; Katsuyuki Maeda, Takatsuki, all of Japan

[73] Assignee: Mitsubishi Jidosha Kogyo Kabushiki Kaisha, Tokyo, Japan

[21] Appl. No.: 544,615

[22] Filed: Jun. 27, 1990

[30] Foreign Application Priority Data

Jun. 27, 1989 [JP] Japan ..... 1-166340

[51] Int. Cl.[5] ..... F02M 51/00

[52] U.S. Cl. ..... 123/489; 123/440

[58] Field of Search ..... 123/489, 440, 492, 493; 60/274

[56] References Cited

U.S. PATENT DOCUMENTS

| | | | |
|---|---|---|---|
| 4,854,287 | 8/1989 | Tomisawa | 123/489 |
| 4,860,712 | 8/1989 | Nakajima et al. | 123/489 |
| 4,878,473 | 11/1989 | Nakinawa et al. | 123/489 |
| 4,889,099 | 12/1989 | Tomishawa | 123/489 |
| 4,913,120 | 4/1990 | Fujimoto et al. | 123/489 |
| 4,932,383 | 1/1990 | Zechnall et al. | 123/489 |
| 4,932,384 | 6/1990 | Woingärtnar | 123/440 |
| 4,964,271 | 3/1988 | Sawada et al. | 60/274 |

*Primary Examiner*—Raymond A. Nelli

*Attorney, Agent, or Firm*—Wegner, Cantor, Mueller & Player

[57] ABSTRACT

An apparatus is provided for controlling the air/fuel ratio of an internal combustion engine. The apparatus includes a sensor disposed in an exhaust system for detecting components of exhaust gas, a device for compulsorily changing the air/fuel ratio, another device for setting a first target value which gives a target air/fuel ratio to be compared with each output from the sensor, and a further device for controlling the air/fuel ratio, which has been compulsorily changed by the air/fuel ratio changing device, on the basis of the result of a comparison between the output and the first target value, whereby the average air/fuel ratio may be controlled to the first target air/fuel ratio. The first target value setting device includes an element for modifying the first target value to a second target value, which gives a leaner air/fuel ratio, in a specific operation state of the engine.

9 Claims, 15 Drawing Sheets

FIG. 11
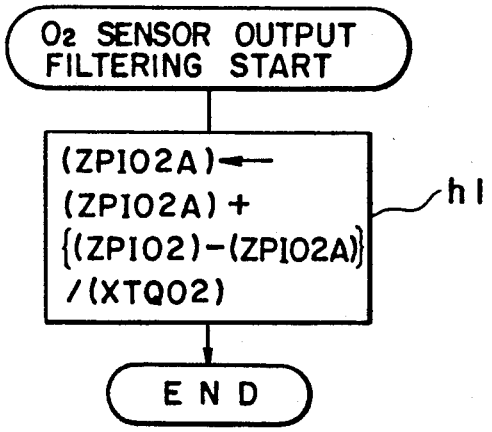
FIG. 12(a)
FIG. 12(b)
FIG. 12(c)
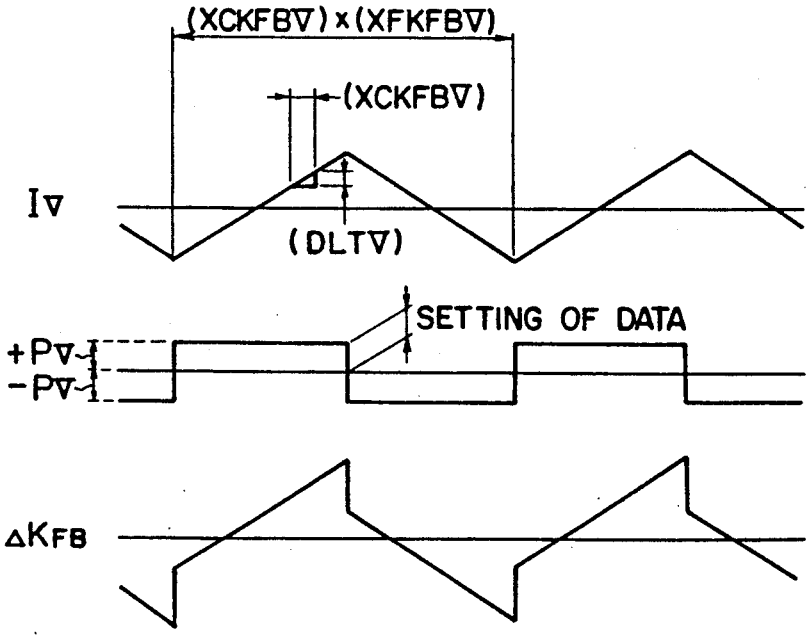

APPARATUS FOR CONTROLLING AIR/FUEL RATIO OF INTERNAL COMBUSTION ENGINE

BACKGROUND OF THE INVENTION

1. Field of the Invention

This invention relates to an apparatus for controlling the air/fuel ratio of an internal combustion engine.

2. Description of the Related Art

An exhaust gas purifying system is conventionally known wherein a three-way catalyst for purifying exhaust gas of an internal combustion engine is disposed in an exhaust system of the internal combustion engine to purify exhaust gas of the engine.

It is already known that the exhaust gas purifying efficiency of such an exhaust gas purifying system can be improved by fluctuating the air/fuel ratio around the theoretical air/fuel ratio.

To this end, an oxygen concentration sensor of the λ type (which denotes an oxygen concentration sensor which presents a sudden change in output value thereof around a predetermined air/fuel ratio (theoretical air/fuel ratio, and such sensor will be hereinafter referred to as $O_2$ sensor) is conventionally provided in an exhaust manifold, i.e., on an upstream side of a catalytic converter. Interested with the fact that the output of such $O_2$ sensor presents a change from an on-state to an off-state, that is, a change from a high voltage level to a low voltage level or vice versa across the predetermined air/fuel ratio (theoretical air/fuel ratio), the output of the $O_2$ sensor is fed back to control the air/fuel ratio so that the air/fuel ratio may remain around the theoretical air/fuel ratio. Such control is called $O_2$ feedback control.

In such $O_2$ feedback control, an output of the $O_2$ sensor is compared with an on/off threshold voltage (reference value), and if, for example, the $O_2$ sensor output is higher than the threshold voltage, the air/fuel ratio is controlled toward the lean side, but on the contrary, if the $O_2$ sensor output is lower than the threshold voltage, the air/fuel ratio is controlled toward the rich side.

With such conventional $O_2$ feedback control, however, there is the possibility that, if the $O_2$ sensor used for the feedback control undergoes a secular change or deterioration, the reliability of control may be deteriorated. Further, quality, in particular, sensitivity dispersion of $O_2$ sensors leads to large dispersion of emission levels. This may also result in a reduction to the reliability of control.

Further, since the maximum frequency of variations in air/fuel ratio is restricted by a delay (waste time) in conveyance of gas from a fuel supply station to the location of the $O_2$ sensor as well as a delay in the response by the sensor, there is the possibility that the capacity of the catalyzer may not be exhibited sufficiently.

Means has thus been proposed for further improving the exhaust gas purifying characteristic of an exhaust gas purifying system of an internal combustion engine. Such means is disclosed, for example, in Japanese Patent Laid-Open No. 56-118535 wherein the air/fuel ratio of an air/fuel mixture to be introduced into a three-way catalyst is changed positively.

With such conventional means, however, since the median of variations of the air/fuel ratio is invariable, there still is the possibility that the air/fuel ratio cannot be changed around the maximum purifying efficiency of the three-way catalyst.

It may hence be contemplated of arranging an $O_2$ sensor on a upstream or downstream side of a catalytic converter to control the compulsorily changed state of the air/fuel ratio, such as the average of variations in the air/fuel ratio (the average air/fuel ratio) on the basis of the results of a comparison between an output from the $O_2$ sensor and a target value corresponding to a desired air/fuel ratio. Such means however involves the following problems when the output of the $O_2$ sensor indicates a rich air/fuel ratio as a result of control by the $O_2$ sensor and the timing of acceleration, for example, in a small intake-air-quantity operation state (low-speed and low-load operation state, low-load operation state, idling state, or the like) before acceleration [see FIG. 19(*a*), point a1]. Since the catalytic converter is in an oxygendeficient state before such acceleration, acceleration FIG. 19(*c*) in such a state leads to the problem that the emission of HC and CO increases immediately after the acceleration [see the characteristic curve shown by a solid line in FIG. 19(*a*)]. In addition, the catalytic converter is brought into an oxygen-excessive lean state because of the control by the $O_2$ sensor after the acceleration [see FIG. 19(*a*), point a2]. This results in a reduction to the efficiency of purification of NOx, so that more NOx is emitted as shown by the dashed characteristic curve in FIG. 19(*b*).

SUMMARY OF THE INVENTION

With the foregoing problems in view, the present invention has as a principal object thereof the provision of an apparatus for controlling the air/fuel ratio of an internal combustion engine, said apparatus being of the type that a compulsorily changed state of the air/fuel ratio is controlled by the results of a comparison between an output from an exhaust gas detection means such as an $O_2$ sensor and a target value so as to control as the target air/fuel ratio the average air/fuel ratio of exhaust gas flowing into a catalytic converter, in which the target value can be changed to a second target value indicative of a leaner air/fuel ratio in a specific operation state such as a small intake-air-quantity operation state so as to avoid deterioration of the purifying efficiency for HC, CO and NOx by the catalytic converter even when the internal combustion engine is accelerated from the specific operation state.

In one aspect of the present invention, there is thus provided an apparatus for controlling the air/fuel ratio of an internal combustion engine equipped with a catalytic converter disposed in an exhaust system, comprising:

- a means disposed in the exhaust system for detecting components of exhaust gas;
- a means for compulsorily changing the air/fuel ratio with a desired amplitude at a desired cycle;
- a means for setting a first target value which gives a target air/fuel ratio to be compared with each output from said exhaust gas detection means; and
- a means for controlling the air/fuel ratio, which has been compulsorily changed by said air/fuel ratio changing means, on the basis of the result of a comparison between the output from said exhaust gas detection means and the first target value from said target value setting means, whereby the average air/fuel ratio may be controlled to the first target air/fuel ratio; and said first target value setting means having a means for modifying the first target value to a second target value, which gives a leaner air/fuel ratio, in a specific operation state of the internal combustion engine.

In the air/fuel ratio control apparatus of the present invention for the internal combustion engine, the air/fuel ratio is compulsorily changed with a desired magnitude at a desired cycle, and further the compulsorily changed state of the air/fuel state by the air/fuel ratio changing means is controlled based on the results of a comparison between an output from the exhaust gas detection means and the first target value from the first target value setting means, whereby the average air/fuel ratio is controlled to the target air/fuel ratio. However, in a specific operation state of the internal combustion engine, the first target value is modified to the second target value, which gives a leaner air/fuel ratio, by the target value modifying means. Therefore, the efficiency of purification of HC, CO and NOx by a catalytic converter is not deteriorated even when the engine is accelerated from the above-described specific operation state.

BRIEF DESCRIPTION OF THE DRAWINGS

The above and other objects, features and advantages of the present invention will become apparent from the following description and the appended claims, taken in conjunction with the accompanying drawings, in which:

FIG. 11 is a flow chart showing a routine for the filtration of an $O_2$ sensor output;

FIGS. 12(*a*), 12(*b*) and 12(*c*) are graphs illustrating operation of the air/fuel ratio controlling apparatus upon compulsory modification of the air/fuel ratio;

DESCRIPTION OF THE PREFERRED EMBODIMENT

Figure 3:
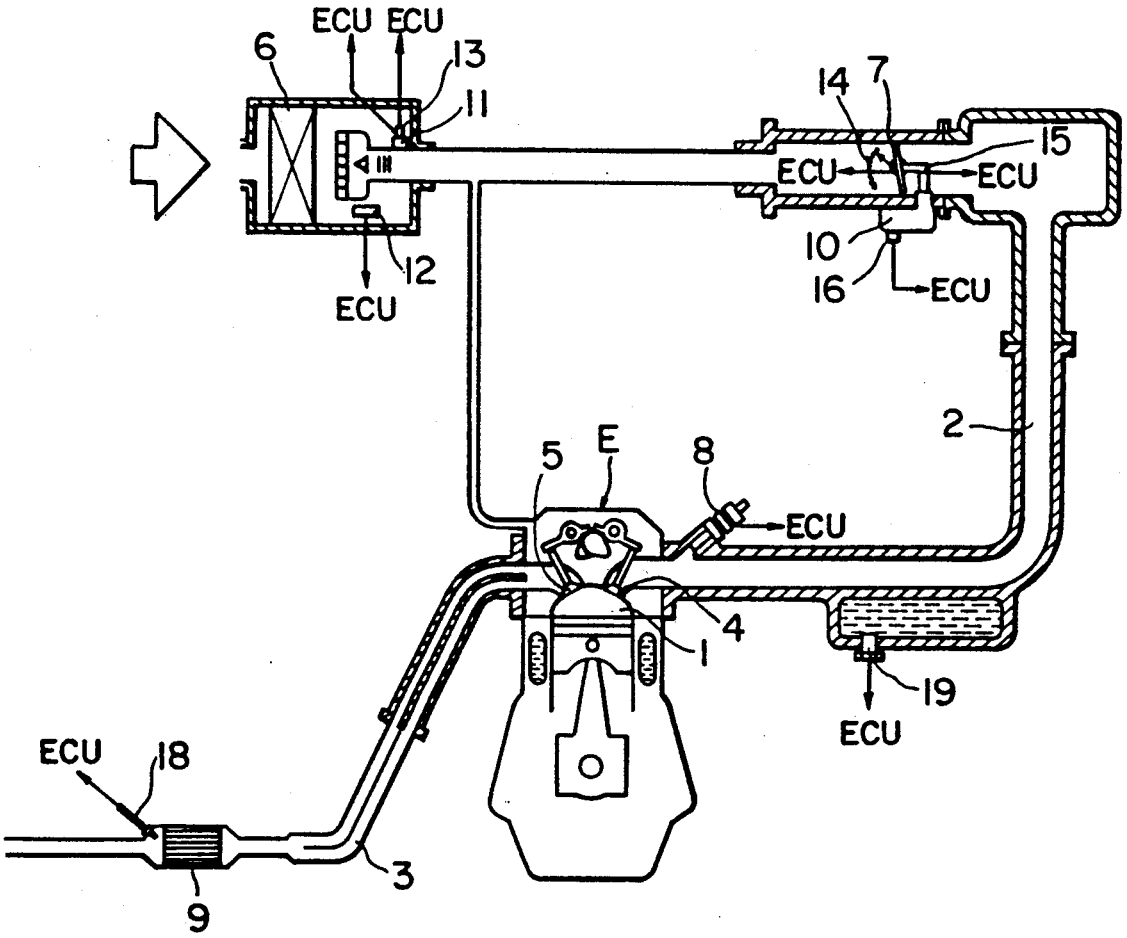
FIG. 3 is a diagrammatic representation showing an entire internal combustion engine system in which the air/fuel ratio controlling apparatus is incorporated.

An engine system to be controlled by the apparatus of the invention may be illustrated as shown in FIG. 3, in which an engine (internal combustion engine) E has an intake air passage or path 2 and an exhaust gas passage or path 3 both communicating with a combustion chamber 1 of the engine E. Communication between the intake air path 2 and the combustion chamber 1 is controlled by an intake valve 4 while communication between the exhaust gas path 3 and the combustion chamber 1 is controlled by an exhaust valve 5.

An air cleaner 6, a throttle valve 7 and electromagnetic fuel injection valves (solenoid valves) 8 are provided in this order from an upstream side along the intake air path 2 while a catalytic converter (three-way catalyst) 9 for the purification of exhaust gas and a muffler (not shown) are provided in this order from the upstream side along the exhaust gas path 3. The intake air path 2 is also provided with a surge tank.

The solenoid valves 8 are provided as many as the number of cylinders of the engine E and located at an intake manifold of the engine E. Assuming that the engine E is an in-line four-cylinder engine, the engine E includes four solenoid valves 8. The engine E can thus be called a so-called multi-point fuel injection (MPI) engine.

The throttle valve 7 is connected to an accelerator pedal (not shown) by way of an unillustrated wire cable such that the degree of opening thereof can be varied in accordance with a treadled amount of the accelerator pedal. The throttle valve 7 is also connected to an idling speed controlling motor (ISC motor) 10 so that it can also be driven to open or close by the latter. Accordingly, the opening degree of the throttle valve 7 can be varied by the idling speed controlling motor 10 during idling without the need for treadling of the accelerator pedal.

With the internal combustion engine E having such a construction as described above, air is taken in by way of the air cleaner 6 in accordance with the degree of opening of the throttle valve 7 and in the intake manifold, is mixed with fuel from the solenoid valve 8 so that a suitable air/fuel ratio may be obtained. Then, the air-fuel mixture is ignited at a suitable timing in the combustion chamber 1 by a ignition plug so that the fuel is burnt thereby to produce an engine torque. After then, the resulting combustion gas is discharged as exhaust gas into the exhaust gas path 3, and then, the exhaust gas is purified by means of the catalytic converter 9 so that the three detrimental components CO, HC and $NO_x$ in the exhaust gas are eliminated. After its noise is deadened in the muffler, it is discharged into the atmosphere.

Various sensors are provided to control the engine E. In particular, an air flow sensor 11 for detecting the quantity of intake air from Karman vortex information, an intake air temperature sensor 12 for detecting the temperature of intake air and an atmospheric pressure sensor 13 for detecting the atmospheric pressure are disposed in the vicinity of the air cleaner 6 on a side of the intake air path 2. A throttle sensor 14 in the form of a potentiometer, which is adapted to detect the degree of opening of the throttle valve 7, an idling switch 15 for detecting an idling condition and a motor position sensor 16 for detecting the position of the ISC motor 10 are disposed around the throttle valve 7 on a side of the intake air path 2.

On a side of the exhaust gas path 3, there are disposed on the downstream side of the catalytic converter 9 an oxygen concentration sensor 18 of the λ type (hereinafter referred to merely as "$O_2$ sensor 18") for detecting the concentration of oxygen ($O_2$ concentration) as one of components of exhaust gas. The $O_2$ sensor 18 of the λ type presents a sudden change in output value thereof around a predetermined air/fuel ratio (theoretical air/fuel ratio).

It is to be noted that the $O_2$ sensor may be disposed inside the catalytic converter 9 at a position near an outlet thereof.

Figure 1:
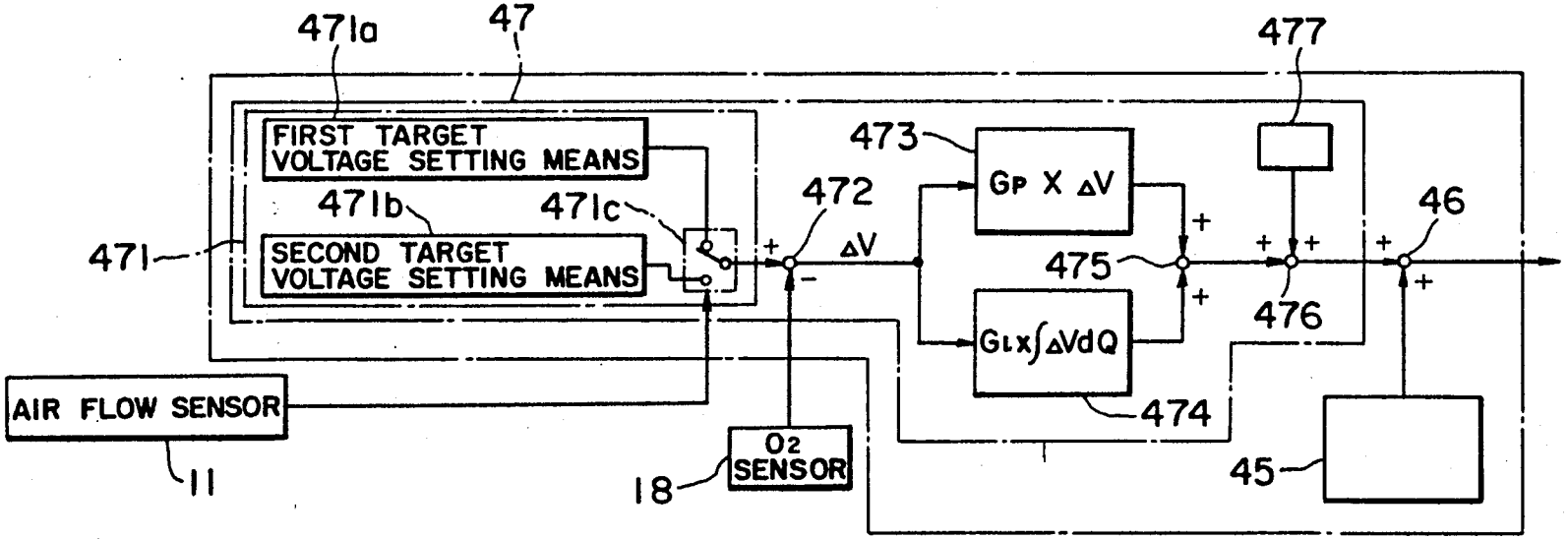
Figure 2:
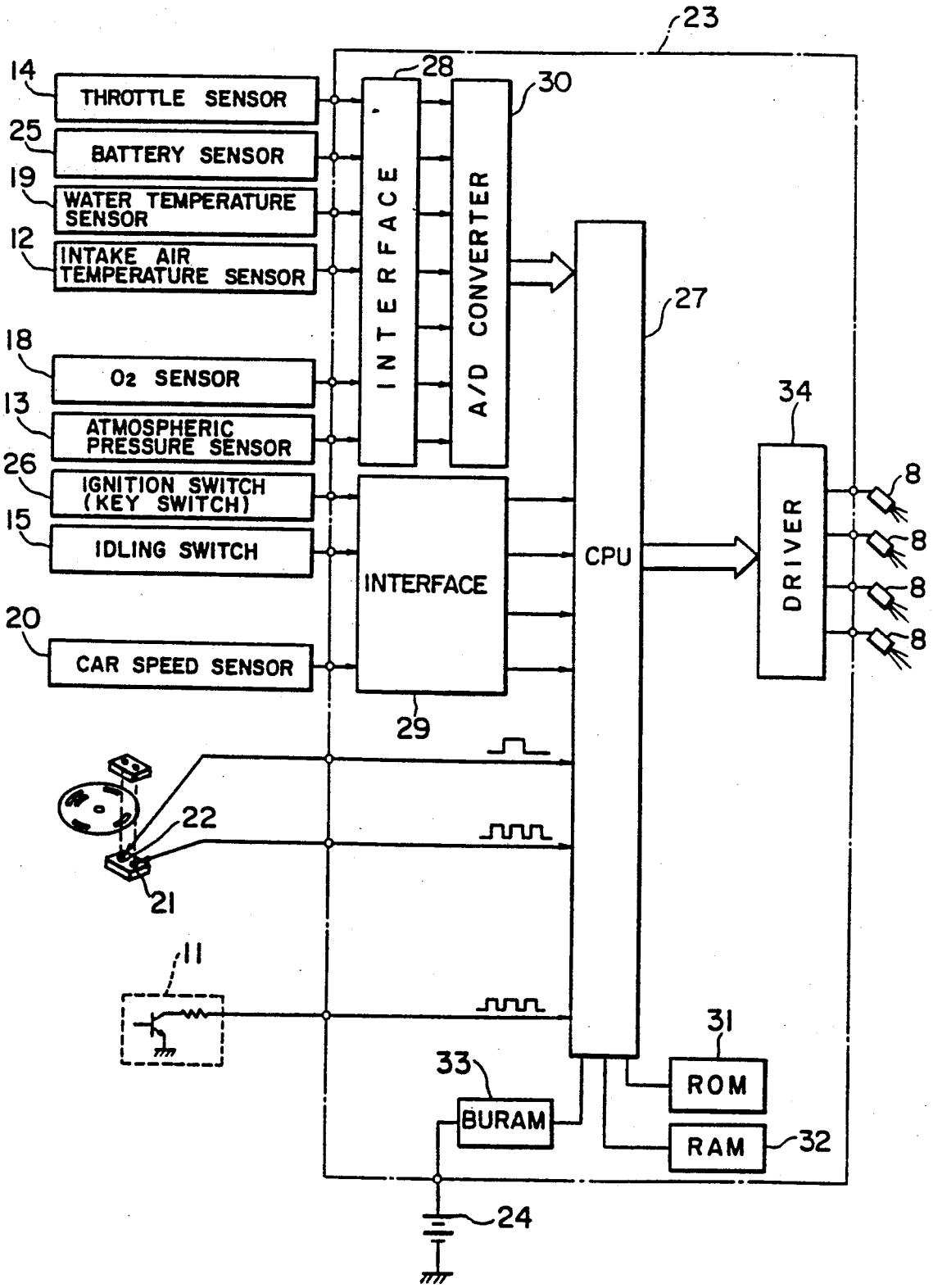
FIG. 2 is a block diagram principally showing the hardware construction of the air/fuel ratio controlling apparatus.

A water temperature sensor 19 for detecting the temperature of engine cooling water and a car speed sensor 20 for detecting the car speed are also provided as seen in FIG. 2. Furthermore, FIGS. 1(*a*) and 2 also depict a crank angle sensor 21 for detecting the crank angle and a TDC (top dead center) sensor 22 for detecting the top dead center position of the first cylinder (reference cylinder) of the engine E are provided on a distributor (not shown). The crank angle sensor 21 also serves as a rotational speed sensor for detecting the rotational speed of the engine E.

Detection signals from these sensors 11 to 16 and 18 to 22 are inputted to an electronic control unit (ECU) 23.

A voltage signal from a battery sensor 25, which detects the voltage of a battery 24, and a signal from an ignition switch (key switch) 26 are also inputted to the ECU 23.

General hardware construction of the ECU 23 is shown in FIG. 2. Referring to FIG. 2, the ECU 23 includes a CPU (central processing unit) 27 as a primary component. The CPU 27 is connected to receive, by way of an input interface 28 and an analog to digital (A/D) converter 30, detection signals from the intake air temperature sensor 12, atmospheric pressure sensor 13, throttle sensor 14, $O_2$ sensor 18, water temperature sensor 19 and battery sensor 25. The CPU 27 is further connected to receive, by way of another input interface 29, detection signals from the idling sensor 15, car speed sensor 20 and ignition switch 26. The CPU 27 is also connected to receive directly at input ports thereof detection signals from the air flow sensor 11, crank angle sensor 21 an TDC sensor 22.

The CPU 27 is further connected by way of a bus line to deliver and receive data to and from a ROM (read only memory) 31 in which program data and invariable value data are stored, a RAM (random access memory) 32 having therein stored data which are successively updated or rewritten, and a battery backed up RAM (BURAM) 33 having therein stored data which are backed up by the battery 24 while the battery 24 is held connected.

It is to be noted that stored data of the RAM 32 are canceled to put the RAM 32 into a reset state whenever the ignition switch 26 is turned off.

Tanking now fuel injection control (air/fuel ratio control) by way of example, a fuel injection controlling signal calculated in accordance with a method which will be subsequently described is delivered from the CPU 27 by way of a driver 34 so that, for example, the four solenoid valves 8 may be driven in a predetermined sequence.

Figure 1A:
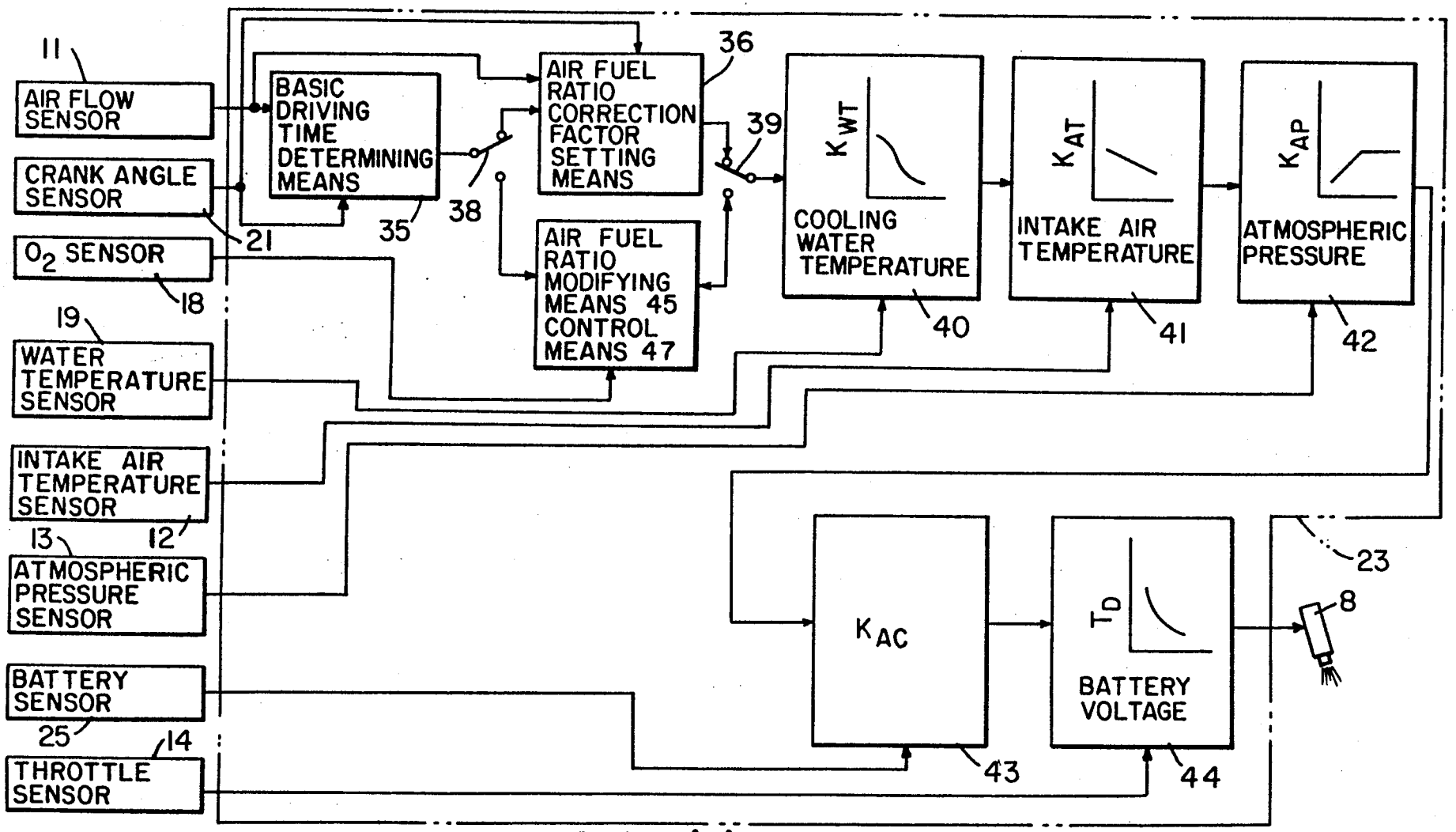
FIG. 1(*a*) is a block diagram of a fuel supply controlling device of an air/fuel ratio controlling apparatus showing a first embodiment of the present invention, and FIG. 1(*b*) is a fragmentary block diagram of the air/fuel ratio controlling apparatus.

FIG. 1(*a*) shows a functional block diagram for such fuel injection control (solenoid valve driving time control). Referring to FIG. 1(a), the ECU 23 includes, from the point of view of software construction, a basic driving time determining means 35 for determining the basic driving time $T_B$ of the solenoid valves 8. The basic driving time determining means 35 receives information on an intake air quantity Q from the air flow sensor 11 and information on an engine rotational speed Ne from the crank angle sensor 21, calculates information on an intake air quantity Q/Ne per full rotation of the engine E, and determines the basic driving time $T_B$ in accordance with the lastmentioned information.

The ECU 23 further includes a cooling water temperature correcting means 40 for setting a correction factor $K_{WT}$ in accordance with the temperature of engine cooling water detected by the water temperature sensor 19, an intake air temperature correcting means 41 for setting a correction factor $K_{AT}$ in accordance with the temperature of intake air detected by the intake air temperature sensor 12, an atmospheric pressure correcting means 42 for setting a correction factor $K_{AP}$ in accordance with the atmospheric pressure detected by the atmospheric pressure sensor 13, an acceleration increment correcting means 43 for setting a correction factor $K_{AC}$ for increase in acceleration, and a dead time correcting means 44 for setting a dead time (invalid time) $T_D$ with which a driving time is to be corrected in accordance with the battery voltage detected by the battery sensor 25.

It is to be noted that the acceleration increment correcting means 43 receives either a signal of the rate of change of Q/Ne or a signal indicative of a rate of change of a throttle opening degree detected by the throttle sensor 14.

The ECU 23 further includes an air/fuel ratio correction factor setting means 36 for setting an air/fuel ratio correction factor $K_{AF1}$ in accordance with the operation state of the engine E (rotational speed of and/or load to the engine E).

The ECU 23 additionally includes an air/fuel ratio modifying means 45 for setting a feedback correction factor $K_{FB}$ to compulsorily vary or fluctuate the air/fuel ratio with a desired magnitude at a desired cycle (for example, 5 to 10 Hz or so), and a control means 47 for controlling the compulsorily varied condition of the air/fuel ratio by the air/fuel ratio modifying means 45 in accordance with an output of the $O_2$ sensor 18. Either one of outputs of the air/fuel ratio modifying means 45 or control means 47 and the air/fuel ratio correction factor setting means 36 is selected by means of a pair of switching means 28 and 29.

When one of the outputs is selected, the selected output is set as a factor $K_{AF}$. This is an operation for setting data of an air/fuel ratio correction factor $K_{AF1}$ and a feedback correction factor $K_{FB1}$ in a common memory (register) area upon calculation of a fuel injection quantity.

Here, the control means 47 is constituted as a means for setting a factor $(K_{FB})_C$ with which an air/fuel ratio median (or average value) is to be corrected in accordance with an output of the $O_2$ sensor 18 in order to change or correct the median (average value) of air/fuel ratios. While the factor $(K_{FB})_C$ is referred to as air/fuel ratio median (average value) correction factor hereinabove, it will be hereinafter referred to as air/fuel ratio median correction factor $(K_{AF})_C$.

It is to be noted that a feedback correction factor $K_{FB}$ is represented as the sum of an air/fuel ratio median correction factor $(K_{FB})_C$ and a compulsory fluctuation $\Delta K_{FB}$.

The air/fuel ratio median correction factor $(K_{FB})_C$ is represented as $1.0+G_P \cdot V+G_I \cdot \int \Delta VdQ$ as will be described later. Here, $\Delta V$ is a variation (deviation) in the output of the $O_2$ sensor 18 and is calculated in accordance with X02TL–ZPI02A where X02TL is a target voltage (a voltage at which the desired air/fuel ratio is attained), and ZPI02A is an output voltage of the $O_2$ sensor 18 after filtering processing, that is, smoothing processing. Such filtering processing will also be hereinafter subsequently. Further, $G_P$ is a proportional gain and $G_I$ is an integral gain, and they are data stored in the ROM in advance.

The air/fuel ratio modifying means 45 and control means 47 described above can also be illustrated by a functional block diagram as shown in FIG. 1(*b*). Referring to FIG. 1(*b*), the control means 47 includes a target voltage setting means 471 as a mans for setting a target value which gives a target air/fuel ratio to be compared with an output from the $O_2$ sensor 18, a deviation calculating means 472, a deviation proportional factor calculating means 473, a deviation integral factor calculating means 474, adding means 475 and 476, and a constant setting means 477.

Here, the target voltage setting means 471 is constructed of a first target voltage setting means 471*a* for setting a first target voltage V1 (for example, 0.5 volt) capable of giving the theoretical air/fuel ratio (or an air/fuel ratio close to the theoretical air/fuel ratio), a second target voltage setting means 471*b* (for example, 0.3 volt) capable of giving a lean air/fuel ratio, and a switching means 471*c* which outputs as a target voltage (X02TL) the first target voltage V1 from the first target voltage setting means 471*a* while no small intake-air-quantity operation state is depicted upon reception of a signal from the air flow sensor 11 but outputs as a target voltage X02TL the second target voltage V2 from the second target voltage setting means 471*b* upon detection of a low-load operation state. Accordingly, the target value changing means for changing the target value to the second target value, which gives a lean air/fuel ratio, in a specific operation state (a small intake-air-quantity operation state such as a low-speed and low-load operation state, a low-load operation state or an idling state) of the engine E is constructed by these second target voltage setting means 471*b* and the switching means 471*c*.

The deviation calculating means 472 calculates the deviation $\Delta V$ of an output voltage ZPI02A of the $O_2$ sensor 18 after filtering processing from the target voltage X02TL (V1 or V2) set by the target voltage setting means 471.

The deviation proportional factor calculating means 473 is provided to calculate $G_P \cdot \Delta V$ while the deviation integral factor calculating means 474 is provided to calculate $G_I \cdot \int \Delta VdQ$.

The adding means 475 adds the result of a calculation $G_P \cdot \Delta V$ from the deviation proportional factor calculating means 473 and the result of another calculation $G_I \cdot \int \Delta VdQ$ from the deviation integral factor calculating means 474 while the other adding means 476 adds $G_P \cdot \Delta V+G_I \cdot \int \Delta VdQ$ and an output of the constant setting means 477.

An adding means 46 is also provided which adds an output of the adding means 477, that is, $1.0+G_P \cdot \Delta V+G_I \cdot \int \Delta VdQ=(K_{FB})_C$, and the output $\Delta K_{FB}$ of the air/fuel ratio modifying means 45.

The solenoid valve 8 is thus driven for a required driving time $T_{INJ}=T_B \times K_{WT} \times K_{AT} \times K_{AP} \times K_{AC} \times K_{AF}+T_D$ calculated from time data and factors found out by such various means as described hereinabove.

Figure 5:
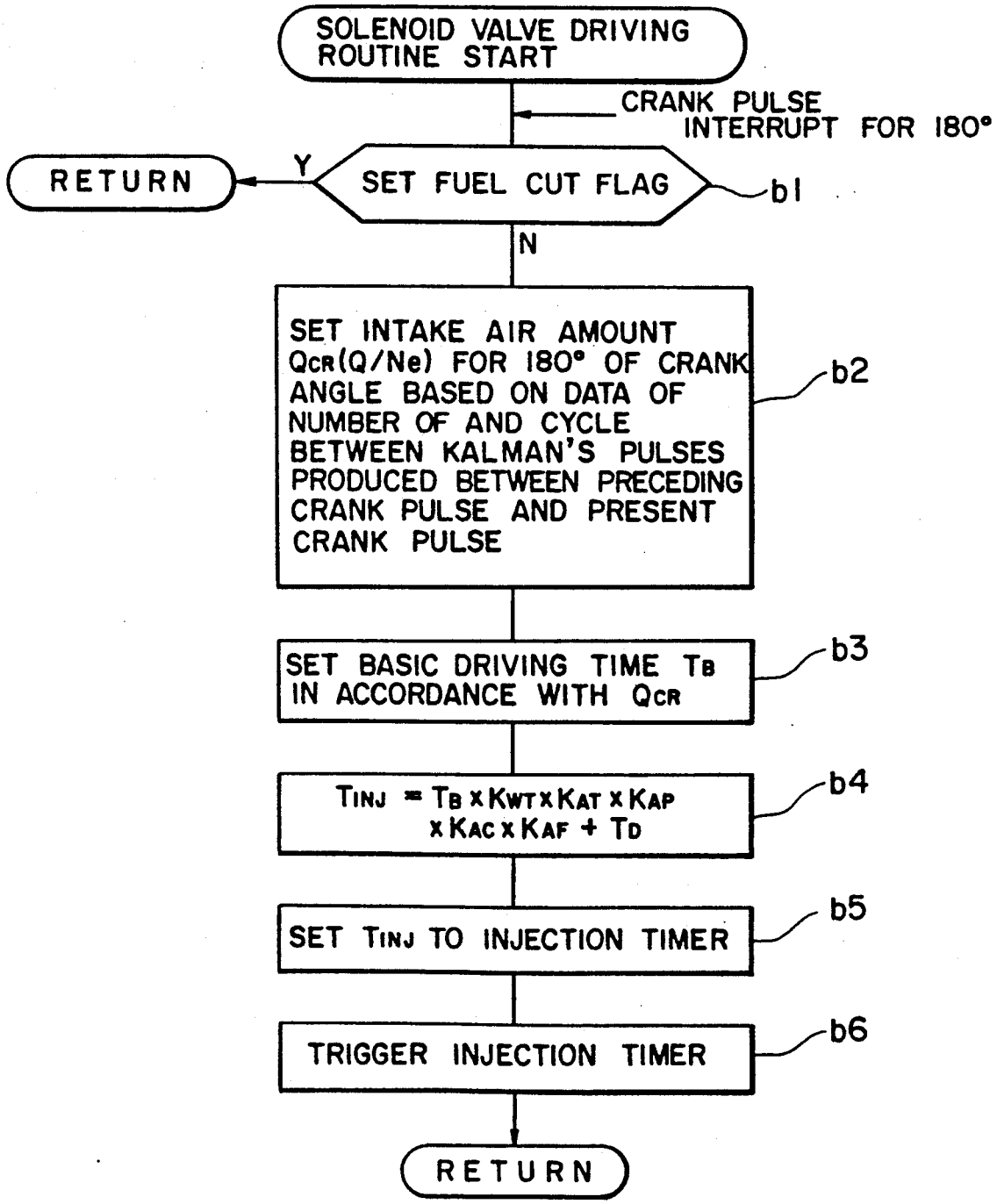
FIG. 5 is a flow chart showing a solenoid valve driving routine.

A control routine for such driving of the solenoid valve 8 is illustrated in the flow chart of FIG. 5. The control routine shown in FIG. 5 is entered by an interrupt in response to a crank pulse for each angular rotation of the crank shaft by 180 degrees. Referring to FIG. 5, it is judged at first in step b1 whether or not a fuel cut flag is in a set state. Where the fuel cut flag is in a set state, fuel injection is not required, and consequently, the sequence returns. Otherwise, the sequence advances to step b2 at which an intake air quantity $Q_{CR}$(Q/Ne) for each 180 degrees of the crank angle is set based on data of the number of and the cycle between Karman pulses produced between the preceding crank pulse and the present crank pulse.

Then at next step b3, the basic driving time $T_B$ is set in accordance with the intake air quantity $Q_{CR}$, and then in step b4, the solenoid valve driving time $T_{INJ}$ is found out by the calculation of $T_B \times K_{WT} \times K_{AT} \times K_{AP} \times K_{AC} \times K_{AF}+T_D$. Subsequently in step b5, the solenoid valve driving time $T_{INJ}$ is set to an injection timer, and then in step b6, the injection timer is triggered. By such triggering, fuel is injected for the period of time $T_{INJ}$.

The outline of air fuel ratio control will next be described with reference to the flow chart of FIG. 4 which shows its main routine.

At first in step al, the CPU 27 reads information on operation conditions of the engine E from the various sensors described hereinabove. Then in step a2, the CPU 27 judges whether or not the engine E is in an operation state in which it is permitted to compulsorily vary or modify the air/fuel ratio. Here, conditions or requirements for such compulsory variation of the air/fuel ratio are as follows:

(1) The $O_2$ sensor 18 is in an active state.

(2) The operation state of the engine E remains within an air/fuel ratio feedback control region (operation state, for example, wherein the load to the engine E is lower than a medium level).

(3) The intake air quantity after the operation state of the engine enters the air/fuel ratio feedback control region is greater than a predetermined value.

(4) The intake air quantity after cutting of fuel is greater than a predetermined value.

(5) A predetermined interval of time has passed after starting of the engine E.

(6) The temperature of engine cooling water is higher than a predetermined value.

If the requirements listed above for compulsory variation of the air/fuel ratio are not met, then the judgment in step a2 is in the negative, and the sequence thus advances to step a3 at which the air/fuel ratio correction factor $K_{AF1}$ is set in accordance with the operation state from a map of the ROM which is defined by Ne and Q/Ne. Then in step a3', the value $K_{AF1}$ is set as $K_{AF}$. Such setting is executed by the air/fuel ratio correction factor setting means 36.

Where the requirements for compulsory variation of the air/fuel ratio are met in step a2, the sequence advances to step a4 at which the air/fuel ratio median correction factor $(K_{FB})_C$ is calculated and then to step a5 at which the compulsory fluctuation $\Delta K_{FB}$ is calculated. Then in step a6, the feedback correction factor $K_{FB}$ is calculated in accordance with $(K_{FB})_C+\Delta K_{FB}$, and then, the value $K_{FB}$ is set as $K_{AF}$ in subsequent step a7. It is to be noted that the operations in steps a4 to a7 are executed by the air-fuel-ratio modification control means 47 (the deviation calculating means 472, deviation proportional factor calculating means 473, deviation integral factor calculating means 474, adding means 475 and 476, and so forth) and the air/fuel ratio modifying means 45.

After execution of either step a3' or step a7, the sequence advances to step a8 in which the remaining factors $K_{WT}$, $K_{AT}$, $K_{AP}$ and $K_{AC}$ are calculated.

Figure 6:
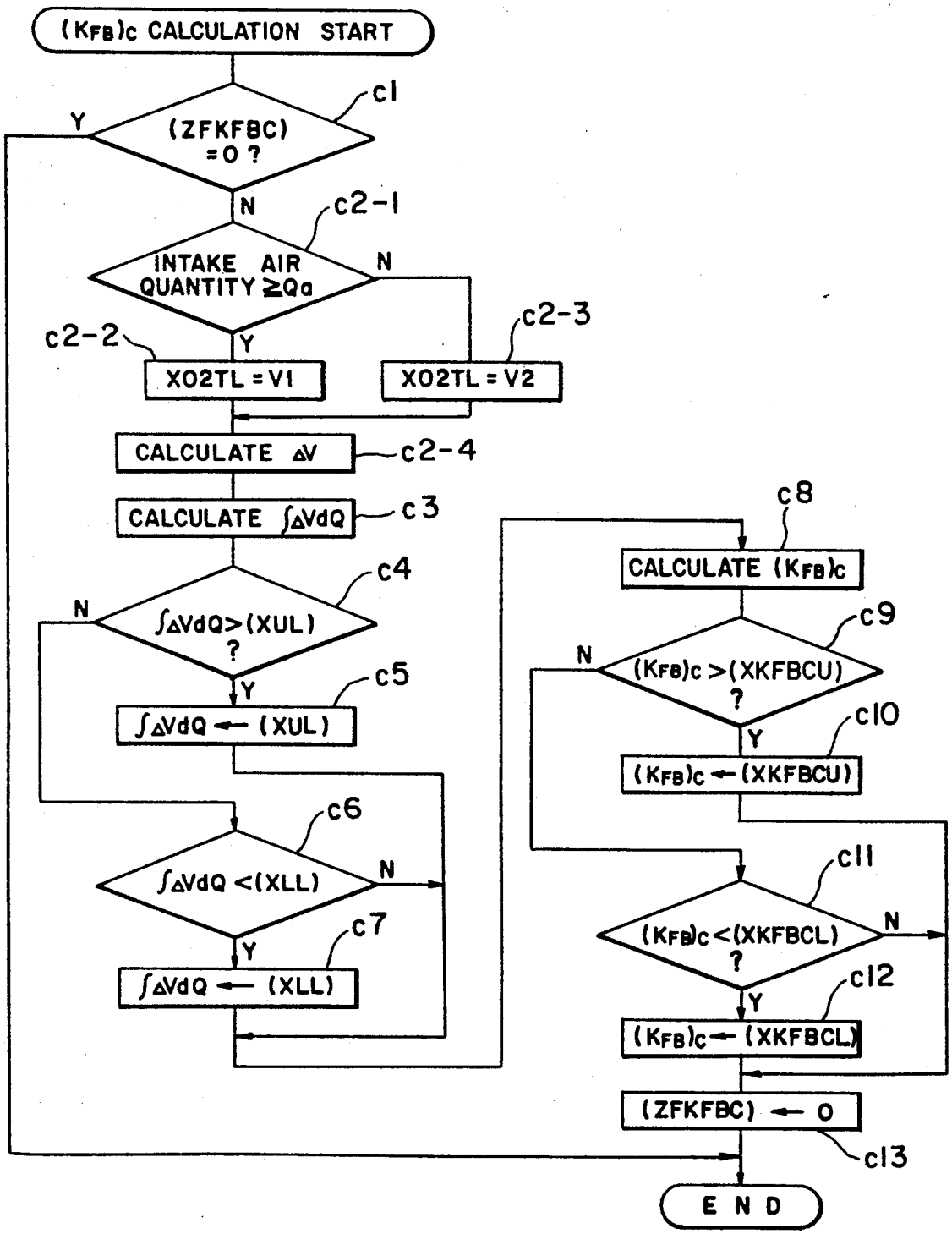
FIG. 6 is a flow chart showing an air/fuel ratio median calculating routine.

Subsequently, a routine for the calculation of an air/fuel ratio median correction factor $(K_{FB})_C$ executed in step a4 of FIG. 4 will be described in more detail with reference to FIG. 6. It is judged a first in step c1 whether the air/fuel ratio median calculation flag ZFKFBC is in a set state or in a reset state. If ZFKFBC=0 (in a reset state), the calculation of the air/fuel ratio median correction factor $(K_{FB})_C$ is not executed. If ZFKFBC≠0 (in a set state), the air/fuel ratio median correction factor $(K_{FB})_C$ is calculated and the value thereof is updated (learned).

Figure 9:
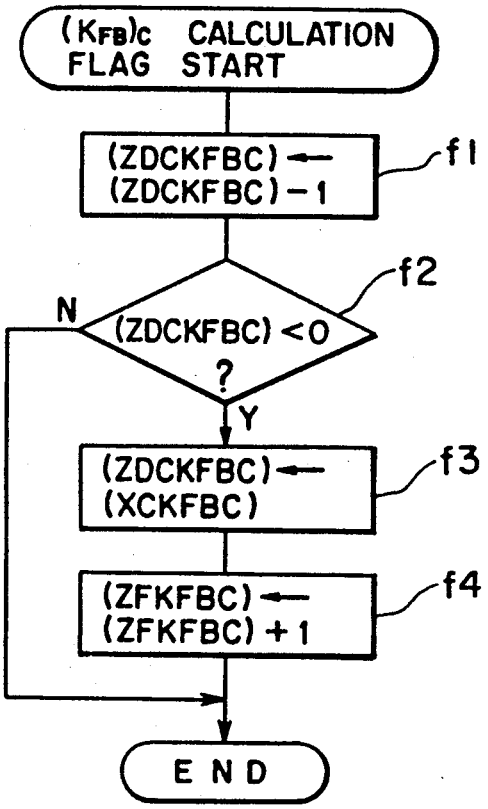
FIG. 9 is a flow chart showing a routine for setting an air/fuel ratio median calculation flag.

Setting of the flag ZFKFBC is conducted as illustrated in FIG. 9. In step fl, a counter or register ZDCKFBC is decremented by one (ZDCKFBC←ZDCKFBC−1) each time a Karman pulse is received. A value XCKFBC is set in advance as an initial value to the counter ZDCKFBC, and the counter ZDCKFBC has the function of dividing Karman pulses in order to define a timing for the calculation of the air/fuel ratio median correction factor $(K_{FB})_C$. The initial value XCKFBC thus represents a cycle for the calculation of an air/fuel ratio median correction factor $(K_{FB})_C$.

Then, in step f2, it is judged whether or not the value of the counter ZDCKFBC is smaller than 0 (ZDCKFBC <0). If ZDCKFBC<0, the initial value XCKFBC is set to the counter ZDCKFBC in subsequent step f3, and the value ZFKFBC of the counter ZDCKFBC is incremented by one to a new value ZFKFBC in next step f4.

Each time the sequence advances to step f4, the flag ZFKFBC is incremented by one unless the value ZFKFBC thereof takes zero. Accordingly, the incremented value also has information on the quantity of intake air. In other words, the flag ZFKFBC not only has a function as a flag for the calculation of the air/fuel ratio median correction factor $(K_{FB})_C$ but also provides information on an intake air quantity, said information being useful for the calculation of the air/fuel ratio median correction factor $(K_{FB})_C$.

Setting of the flag ZFKFBC is executed as described above. After such setting is executed, the flag ZFKFBC presents a value other than zero. Consequently, in step c1 of the routine shown in FIG. 6, the judgment then is in the negative, and accordingly, the sequence advances to step c2-1 where it is judged whether the quantity of the intake air is greater than the small intake air quantity Qa. If the quantity of the intake air is equal to or greater than the small intake air quantity Qa (if the engine is not in a low-speed and low-load operation state or in a low-load operation state), the routine advances through the YES route and in step c2-2, the target voltage X02TL is set at the first target voltage V1 (for example, 0.5 volt). If the quantity of the intake air is less than the small intake air quantity Qa (if the engine is in an idling state, a low-speed and low-load operation state or a low-load operation state), the routine advances through the NO route and in step c2-3, the target voltage X02TL is set at the second target voltage V1 (for example, 0.3 volt). The processings in these steps are performed by the target voltage setting means 471.

Subsequent to step c2-2 or c2-3, the deviation ΔV is calculated in step c2-4. The calculation in step c2-4 is executed by the deviation calculating means 472. It is to be noted that the deviation ΔV is calculated in accordance with X02TL−ZPI02A as described above.

Here, X02TL is a target voltage (V1 or V2), and ZPI02A is an output voltage of the $O_2$ sensor 18 after filtering processing (smoothing processing). In this instance, the filtering processing means that a value obtained by suitable weighting between the present output value of the $O_2$ sensor 18 and the output value used in the preceding calculation is determined as an output value of the $O_2$ sensor 18. A flow chart for such processing is shown in FIG. 11.

Referring to FIG. 11, a value obtained by ZPI02A +(ZPI02−ZPI02A)/XTQ02 is determined as a new value of ZPI02A in step h1. Here, ZPI02 is an instantaneous value of the output of the $O_2$ sensor 18 (the value is obtained by analog to digital conversion of the output value after each required interval of time), and XTQ02 is a value (pulse number) corresponding to a time constant of a means for the filtering processing (a so-called filtering circuit).

Now, modifying ZPI02A+(ZPI02−ZPI02A)/XTQ02, we obtain $$(1-1/XTQ02)ZPI02A+(1/XTQ02)ZPI02=(1-k)\cdot ZPI02A+k\cdot ZPI02$$

wherein k is a weighting factor and is set to a value defined by 0≦k≦(normally k≠0 and k≠1).

Output noise components are thus cut if the filtering processing of the output of the $O_2$ sensor 18 is executed in this manner.

Referring back to FIG. 6, after the calculation of the deviation ΔV in accordance with the output of the $O_2$ sensor 18 after the filtering processing, the deviation integrated value ∫ΔVdQ is calculated in subsequent step c3. The processing is executed by the deviation integral factor calculating means 474. It is to be noted that the value ∫ΔVdQ is calculated by the addition of a variation ΔV×ZFKFBC×XCKFBC to the present value of ∫ΔVdQ.

Here, ZFKFBC×XCKFBC corresponds to the number of Karman pulses, that is, the intake air quantity. For this reason, it has been described above that ZFKFBC also provides information on the intake air quantity useful for the calculation of the air/fuel ratio median correction factor $(K_{FB})_C$.

Then, a processing is executed to restrict the deviation integrated value ∫ΔVdQ within a predetermined range (for example, −100 to 100 Vl). Namely, in step c4, it is judged whether or not $\int \Delta VdQ$ is greater than an upper limit value XUL. If so, the upper limit value XUL is set as the deviation integrated value $\int \Delta VdQ$ to clip the upper limit of the value $\int \Delta VdQ$ in step c5. If the value $\int \Delta VdQ$ is not greater than the upper limit value XUL in step c3, then it is judged in step c6 whether or not the value $\int \Delta VdQ$ is smaller than a lower limit value XLL, and if the value $\int \Delta VdQ$ is smaller than the lower limit value XLL, the lower limit value XLL is set to the deviation integrated value $\int \Delta VdQ$ to clip the lower limit of the value $\int \Delta VdQ$ in step c7, After the value $\int \Delta VdQ$ is restricted within the predetermined range in this manner, the air/fuel ratio median correction factor $(K_{FB})_C$ is calculated in step c8 using the values $\Delta V$ and $\int \Delta VdQ$ to thus update the value of the air/fuel ratio median correction factor $(K_{FB})_C$. Namely, the processing of $(K_{FB})_C \leftarrow 1.0 + G_P \cdot \Delta V + G_I \cdot \int \Delta VdQ$ is executed. Here, $G_P$ is a proportional gain and $G_I$ is an integral gain, as described above.

Such calculations are executed by the deviation proportional factor calculating means 473, deviation integral factor calculating means 474, adding means 475 and 476 and so forth.

After then, a processing is executed to restrict the updated value $(K_{FB})_C$ within a predetermined range (for example, 0.8 to 1.2). Namely, in step c9, it is judged whether or not the value $(K_{FB})_C$ is greater than an upper limit value XKFBCU. In case the judgment is in the affirmative, the upper limit value XKFBCU is set as the value $(K_{FB})_C$ to clip the upper limit of the value $(K_{FB})_C$ in step c10. On the contrary, if the judgment in step c9 is in the negative, then it is judged at subsequent step c11 whether or not the value $(K_{FB})_C$ is smaller than a lower limit value XKFBCL. If the judgment is in the affirmative, then the lower limit value XKFBCL is set as the value $(K_{FB})_C$ to clip the lower limit of the value $(K_{FB})_C$.

After the factor $(K_{FB})_C$ is restricted within the predetermined range in this manner, the flag ZFKFBC is reset to 0 in step c13.

Figure 7:
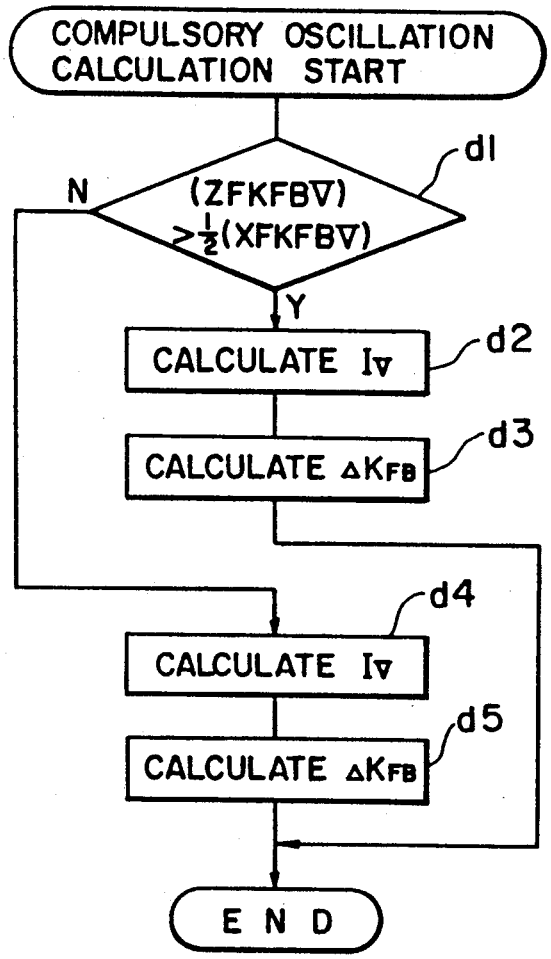
FIG. 7 is a flow chart showing a routine for the calculation of an amount by which the air/fuel ratio is to be compulsorily modified.

A routine for the calculation of compulsory fluctuations executed in step a5 of FIG. 4 will next be described with reference to FIG. 7. In the routine shown, it is judged at first in step d1 whether or not the value of a counter ZFKFBV is greater than one half the compulsory fluctuation cycle XFKFBV of, for example, 5 to 10 Hz.

It is to be noted that the compulsory fluctuation cycle XFKFBV is smaller than a fluctuation cycle (normally 2 to 5 Hz or so) in ordinary air/fuel ratio feedback control wherein feedback control of the air/fuel ratio is executed in accordance with a detection signal from the $O_2$ sensor which is provided neat the outlet of the combustion chamber 1 on the upstream side of the catalytic converter 9.

Figure 10:
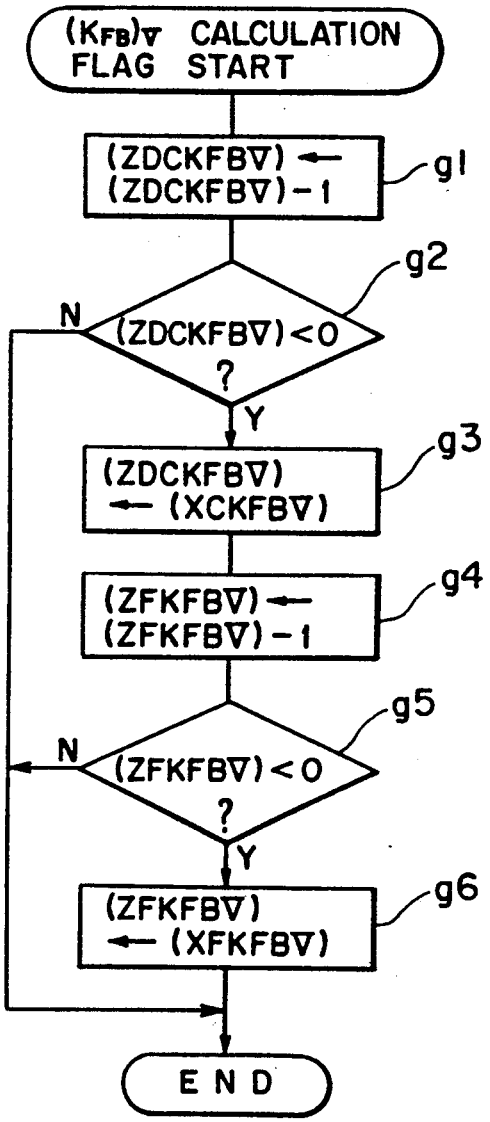
FIG. 10 is a flow chart showing a routine for the increment of an air/fuel ratio modification calculation timer.

Here, the value of the timer ZFKFBV is incremented in accordance with the flow chart shown in FIG. 10. Referring to FIG. 10, at first in step g1, the value of the counter ZDCKFBV is decremented by one each time a Karman pulse is received (ZDCKFBV←ZDCKFBV−1). The counter ZDCKFBV has an initial value XCKFBV set in advance therein and has a function of dividing Karman pulses in order to define a timing for the calculation of a compulsory fluctuation $\Delta K_{FB}$. In other words, the timing for the calculation of the compulsory fluctuation $\Delta K_{FB}$ comes after each lapse of an interval of time defined by the initial value XCKFBV.

After then, it is judged in step g2 whether or not the value of the counter ZDCKFBV is smaller than zero (ZDCKFBV<0). If ZDCKFBV<0, then the initial value XCKFBV is set to the counter ZDCKFBV in step g3, and the value ZFKFBV is decremented by one to a new ZFKFBV in step g4.

Subsequently in step g5, it is judged whether or not the value ZFKFBV is smaller than 0 (ZFKFBV<0), and if ZFKFBV<0, then the compulsory fluctuation cycle ZFKFBV is set to the timer ZFKFBV in step g6.

In this manner, the timing for the calculation of a compulsory fluctuation $\Delta K_{FB}$ can be produced after each lapse of an interval of time defined by the initial value XCKFBV as a unit one of intervals of time into which the compulsory fluctuation cycle XFKFBV is divided.

The count value of the timer ZFKFBV is obtained as described above. A processing of making the air/fuel ratio richer and another processing of making the air/fuel ratio leaner are executed separately on the opposite sides of a point of time when the timer value ZFKFBV assumes just one half the compulsory fluctuation cycle XFKFBV.

In particular, referring back to FIG. 7, if it is judged in step d1 that the timer value ZFKFBV is greater than one half the compulsory fluctuation cycle XFKFBV, then a processing for making the air/fuel ratio richer is executed subsequently. But on the contrary, if it is not judged in step d1 that the timer value ZFKFBV is greater than one half the compulsory fluctuation cycle XFKFBV, then a processing for marking the air/fuel ratio leaner is subsequently executed.

For the processing for making the air/fuel ratio richer, at first in step d2, a compulsory fluctuation integral component IV for making the air/fuel ratio richer is calculated in accordance with the following equation.

$$I_V = \{(\tfrac{1}{2})XFKFBV - ZFKFBV\} \times DLTV$$

where DLTV is a value which is to be added for each execution of the calculation.

After then, a compulsory fluctuation component $\Delta K_{FB}$ for making the air/fuel ratio richer is calculated in accordance with $P_V + I_V$, where $I_V$ is the value calculated in step d2 above, and $P_V$ is a compulsory fluctuation proportional component.

On the other hand, for the processing for making the air/fuel ratio leaner, at first in step d4, a compulsory fluctuation integral component $I_V$ for making the air/fuel ratio leaner is calculated in accordance with the following equation.

$$I_V = \{XFKFBV - (\tfrac{1}{2})ZFKFBV\} \times DLTV$$

After then, in step d5, a compulsory fluctuation component $\Delta K_{FB}$ for making the air/fuel ratio leaner is calculated in accordance with $-P_V + I_V$, where $I_V$ is the value calculated in step d4 above.

The compulsory fluctuation $\Delta K_{FB}$ is calculated in this manner. Since the timing for the calculation of such compulsory fluctuation $\Delta K_{FB}$ has a synchronized relationship with Karman pulses, the cycle time of the compulsory fluctuation $\Delta K_{FB}$ is a function of an intake air quantity, and consequently, the fluctuation cycle is varied in response to an intake air quantity. Accordingly, a suitable fluctuation cycle can be set in accordance with a change in intake air quantity.

Exemplary variations of the values $I_V$, $P_V$ and $\Delta K_{FB}$ shown in FIGS. 12(*a*), 12(*b*) and 12(*c*), respectively. In this instance, the compulsory variation presents a chopping-wave-like fluctuations as seen from FIG. 12(*c*).

Figure 4:
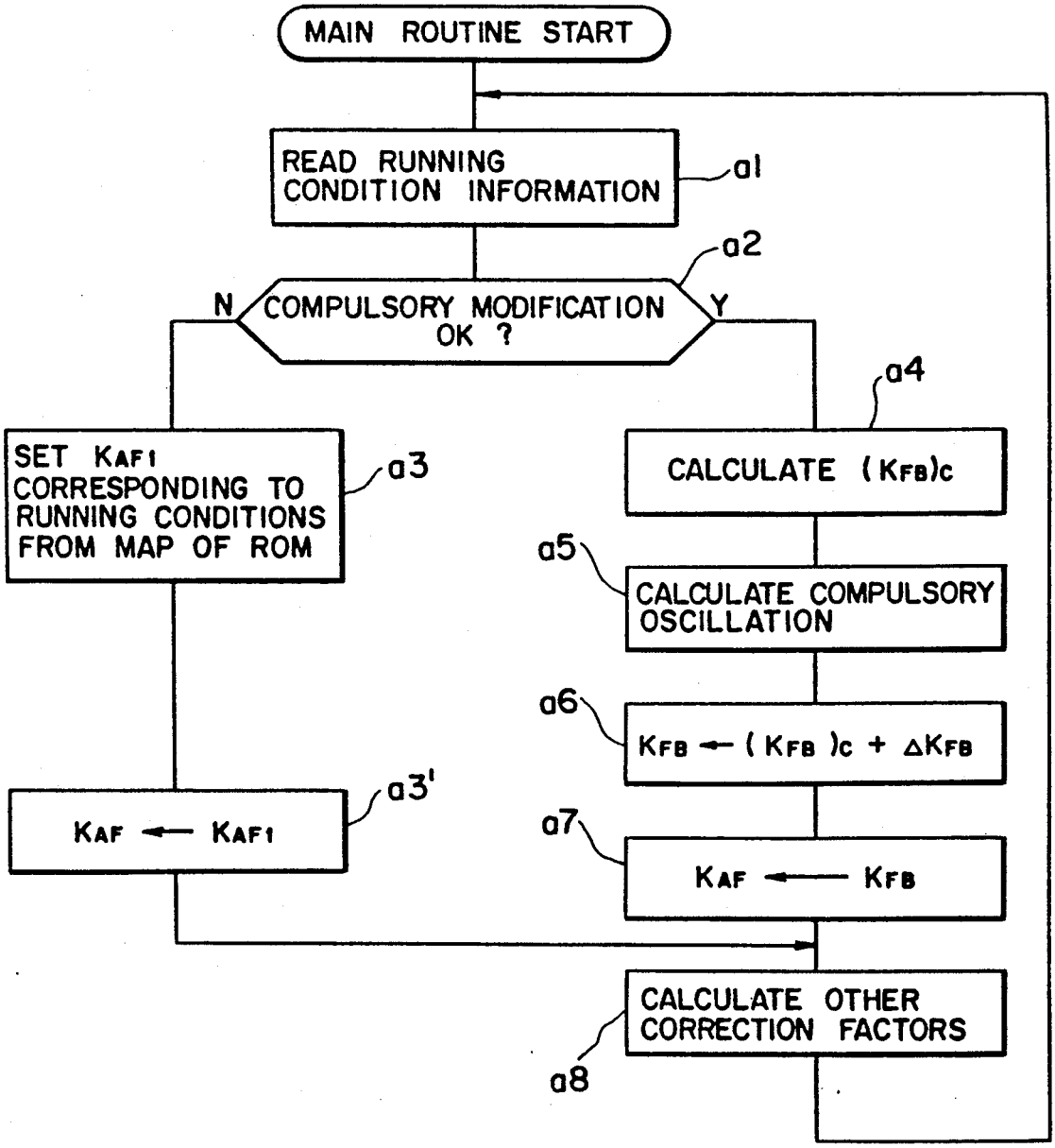
FIG. 4 is a flow chart of a main routine illustrating the outline of air/fuel ratio control by the air/fuel ratio controlling apparatus.
Figure 8:
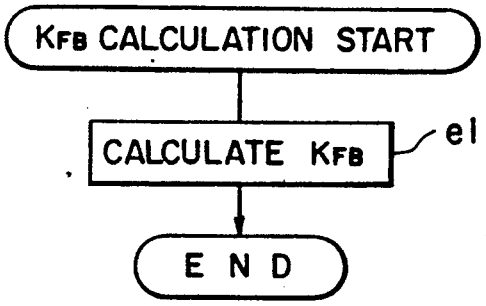
FIG. 8 is a flow chart showing a feedback correction factor calculating routine.

After the air/fuel ratio median correction factor $(K_{FB})_C$ and the compulsory fluctuation $\Delta K_{FB}$ have been determined as described above, the calculation of a feedback correction factor $K_{FB}$ is executed in step a6 of FIG. 4 as described above. The calculation is executed in accordance with the routine of the flow chart shown in FIG. 8. The routine of FIG. 8 includes only a single step el. The value $K_{FB}$ is set as $K_{AF}$ and the other factors are then calculated (see steps a7 and a8 in FIG. 4).

With the construction described above, when the engine is in a operation state wherein compulsory fluctuations are permitted, the air/fuel ratio median correction factor $(K_{FB})_C$ and the compulsory fluctuation $\Delta K_{FB}$ are calculated in order that the average fuel injection quantity can be feedback controlled to bring the output (actually the filtered output) ZPI02A of the $O_2$ sensor 18 provided on the downstream side or inside of the catalytic converter 9 into conformity with the target voltage X02TL, whereby the air/fuel ratio median correction factor $(K_{FB})_C$ is updated (learnt). The air/fuel ratio is fluctuated with a desired magnitude at a desired cycle (which is a function of the intake air quantity) around a median at which the air/fuel ratio is determined with the air/fuel ratio median correction factor $(K_{FB})_C$. When the air/fuel ratio is varied compulsorily in this manner, the median in variation thereof is corrected with the coincident output of the $O_2$ sensor 18. Accordingly, the air/fuel ratio can be controlled so that the purifying efficiency of the catalytic converter may present a maximum level.

Figure 13A:
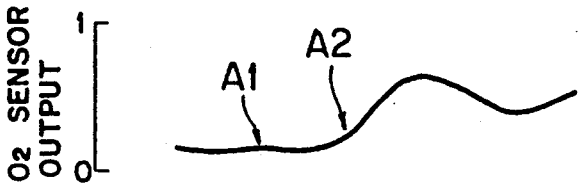
FIGS. 13(*a*), 13(*b*) and 13(*c*) are graphs showing operation of the air/fuel ratio controlling apparatus upon acceleration.
Figure 13B:
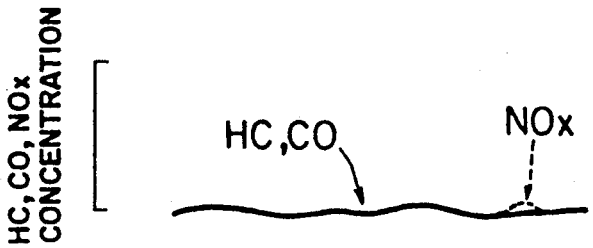
Figure 13C:
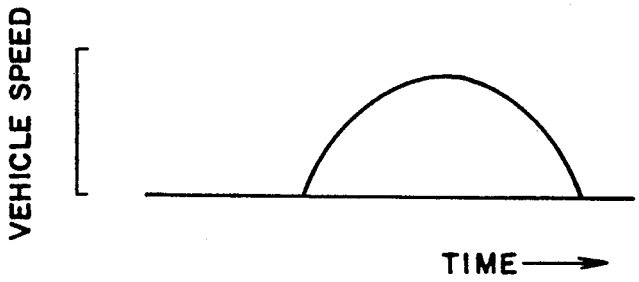

Even when the engine is in an operation state in which compulsory fluctuations are feasible, the target voltage X02TL is modified to the second target voltage V2 which gives a lean air/fuel ratio in a small intake-air-quantity operation state such as an idling state, a low-speed and low-load operation state or a low-load operation state. Accordingly, the output of the $O_2$ sensor, in other words, the exhaust gas flowing into the catalytic converter 9 is always in a lean state [see A1 of FIG. 13(*a*)] in such a low-load operation state of the engine (i.e., in a small intake-air-quantity operation state). Incidentally, in this state, the NOx component emitted is so little that it can be ignored, because the flow rate of exhaust gas is low or the combustion temperature is relatively low. Let's think of the situation that acceleration is effected from such a lean state as illustrated in FIG. 13(*c*). Since the catalytic converter 9 is in an oxygen-excessive state before the acceleration, this excessive oxygen and HC and CO emitted from the engine react so that the emission of HC and CO is reduced immediately after the acceleration (see the characteristic curve shown by a solid line in FIG. 13(*b*)]. Owing also to the $O_2$ sensor control using the target voltage changed to the first target voltage V1, the catalytic converter 9 is in a rich state after the acceleration. The efficiency of purification for NOx is therefore improved and, as a result, the amount of NOx to be emitted form the vehicle can be reduced [see the characteristic curve shown by broken lines in FIG. 13(*b*)].

Figure 14:
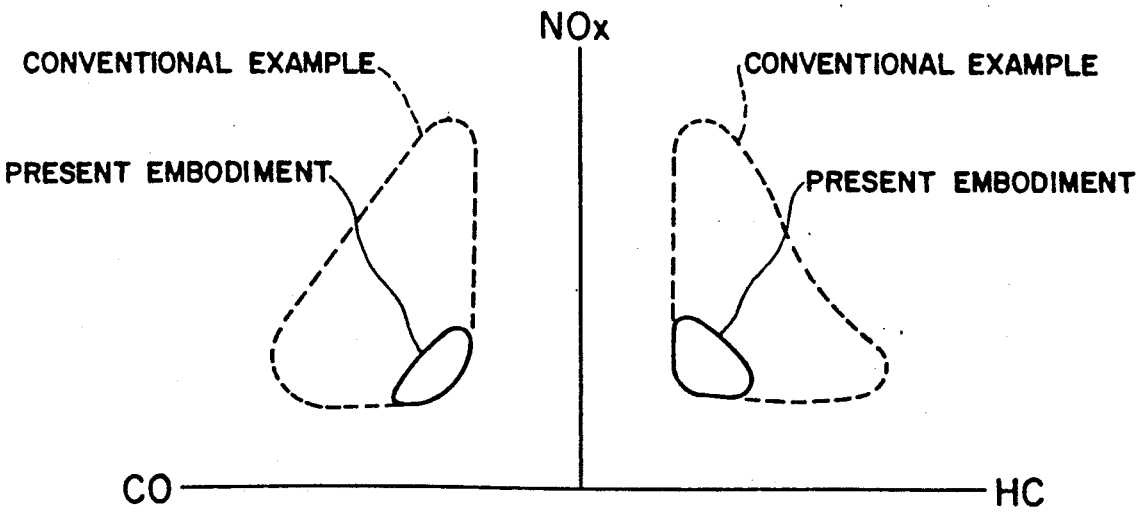
FIG. 14 diagrammatically shows the relationship among HC, CO and NOx in both the first embodiment and a conventional example.

Effects in an actual exhaust gas mode are illustrated in FIG. 14. As is also seen from FIG. 14, the present embodiment can reduce all of HC, CO and NOx (see the area indicated by the solid line in FIG. 14), while in the conventional example described above, a reduction of any one of HC, CO and NOx results in an increase of at least one of the remaining ones and it is impossible to reduce all of HC, CO and NOx (see the area indicated by the dashed line in FIG. 14).

Further, since the $O_2$ sensor 18 is provided on the downstream side or inside the catalytic converter 9, unburnt components in exhaust gas are reduced and the control λ point (point at which the output of the $O_2$ sensor 18 presents a sudden change) approaches the theoretical air/fuel ratio, and further, fluctuations in the emission level are reduced. In addition, since the influence of a delay in response inherent to the engine system can be eliminated, a good exhaust gas purifying characteristic can also be expected from the point.

Figure 15:
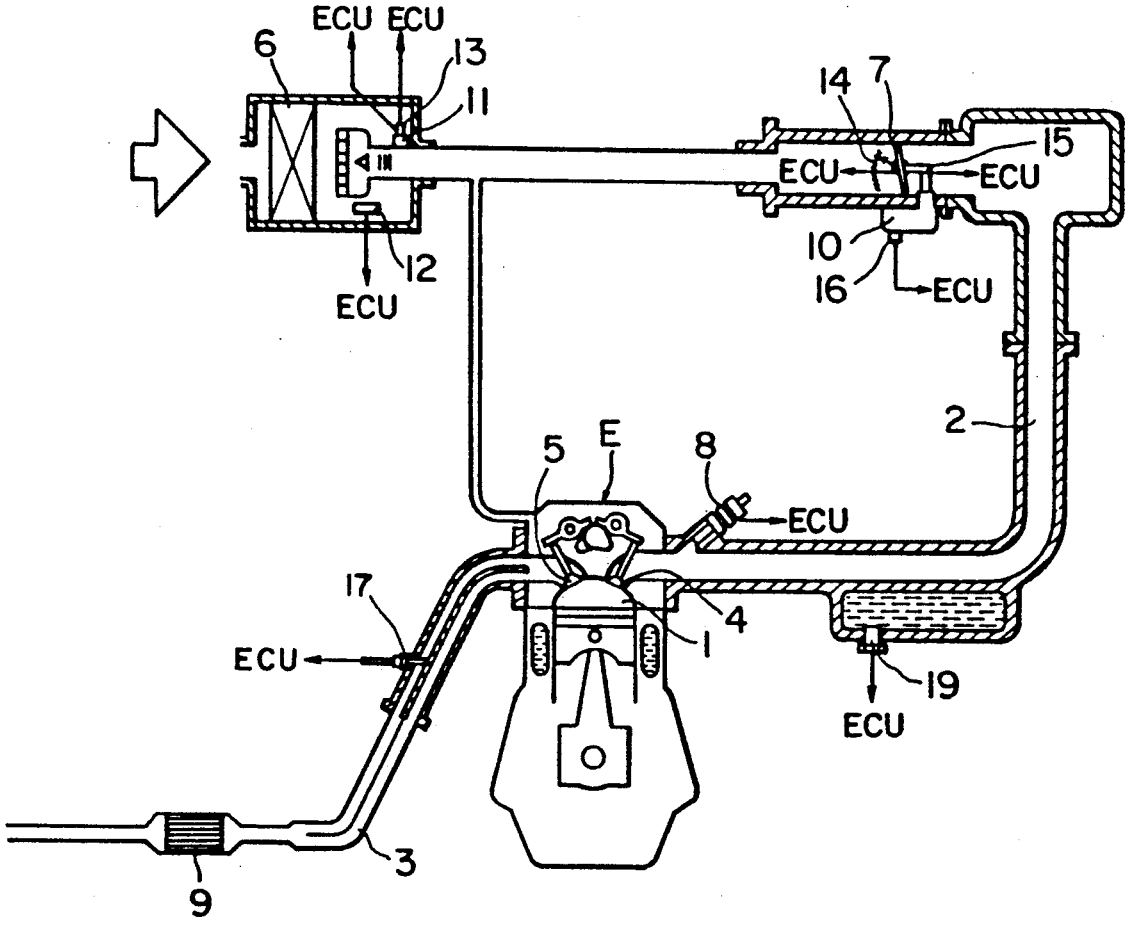
FIG. 15 is a schematic overall illustration showing an engine system in which the present invention is incorporated with an $O_2$ sensor arranged on the upstream side of a catalytic converter.

Incidentally, it is possible to provide a catalyst-layer-bearing $O_2$ sensor 17 on an upstream side of the catalytic converter 9 as illustrated in FIG. 15 and by using an output from the $O_2$ sensor 17, to perform similar control to the above-described embodiment.

Figure 16:
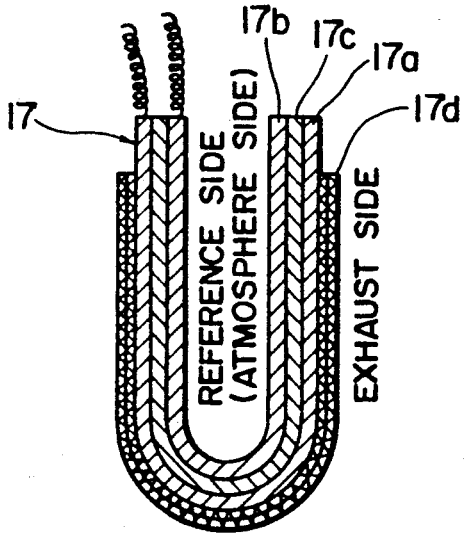
FIG. 16 is a schematic cross-section of the $O_2$ sensor shown in FIG. 15.

As shown in FIG. 16, the $O_2$ sensor 17 has an exhaust-path-side platinum electrode 17*a* which is coated by a catalyst layer (three-way catalyst layer) 17*d* having oxidation-reduction ability. In FIG. 16, numeral 17*b* indicates an atmosphere-side platinum electrode and numeral 17*c* designates a solid electrolyte portion composed of $ZrO_2$ or the like.

It is to be noted that, while the latest values of the deviation integration value $\int \Delta VdQ$ and the compulsory fluctuation $\Delta K_{FB}$ described above are stored in the RAM, the stored values are maintained until the battery is unloaded or the engine key is brought into an off-state.

Further, the deviation integration value $\int \Delta VdQ$ and hence the compulsory fluctuation $\Delta K_{FB}$ may be stored for each of a small intake-air-quantity operation zone such as an idling zone and the other engine operation zone. The latter engine operation zone may be divided further into plural zones. In this instance, only when the engine is within the corresponding operation zone, the latest value of the deviation integration value $\int \Delta VdQ$, hence, of the compulsory fluctuation $\Delta K_{FB}$ may be updated and stored, but when the engine is in any other operation zone, the value of the deviation integration value $\int \Delta VdQ$, hence, the compulsory fluctuation $\Delta K_{FB}$ may be reset. As an alternative, operation state of the engine changes from the corresponding operation zone to another operation zone, the value of the deviation integration value $\int \Delta VdQ$, hence, the compulsory fluctuation $\Delta K_{FB}$ immediately before the change may be stored, and when the operation state of the engine returns to the latter operation zone again, the value just before the change is restored to execute updating of the latest value Upon performing the above-described compulsory fluctuations, fluctuations may be effected in the form of rectangular waves (refer to FIGS. 17 and 18), sine waves or some other composite waves, in addition to the chopping waves described above.

Figure 17:
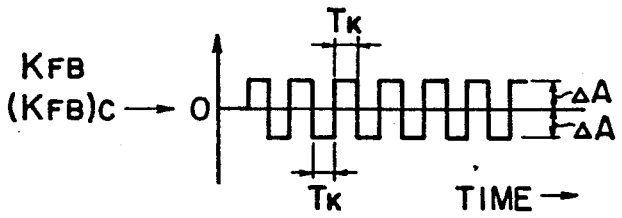
FIGS. 17 and 18 diagrammatically depict effects of other examples upon compulsorily changing the air/fuel ratio.

Here, also in the case of FIGS. 17 and 18, $K_{FB}$ and $(K_{FB})_C$ are given as follows.

$$K_{FB}=(K_{FB})_C+K_{FB}$$

$$(K_{FB})_C=1.0+G_P\Delta V+G_I\int \Delta VdQ$$

$\Delta V$ is given by X02TL−ZPI02A. On the other hand, $G_P$ and $G_I$ are mapped relative to Karman frequencies, and the value of $\int \Delta V dQ$ and hence the value of $K_{GB}$ are updated (learned) for each operation zone of the engine.

Further, the magnitude $\Delta A$ and the rectangle width $T_K$ may also be mapped relative to Karman frequencies or for reciprocals thereof even if they have constant values (including the case wherein they have constant values for the entire operation range of the engine and the case wherein they have constant values for each of plural operation zones of the engine).

Figure 18:
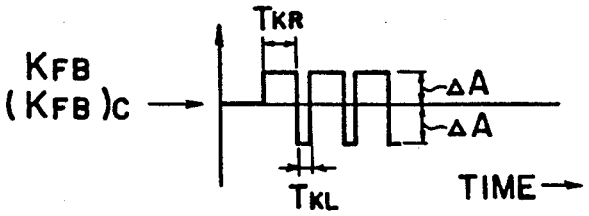
Figure 19A:
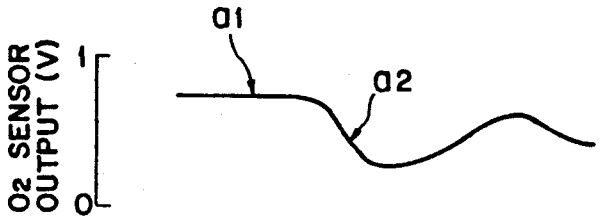
FIGS. 19(*a*), 19(*b*) and 19(*c*) are graphs showing effects of a conventional apparatus upon acceleration.
Figure 19B:
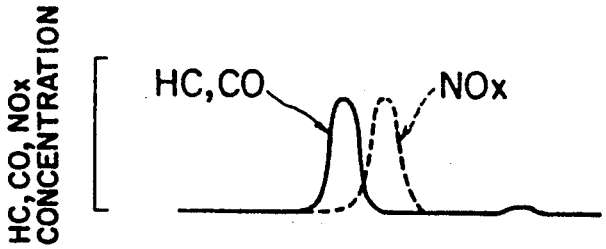
Figure 19C:
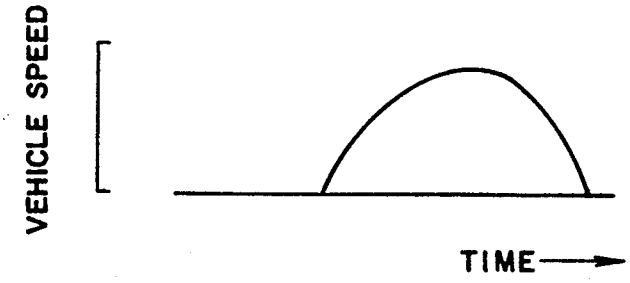

In the case of FIG. 18, controlled is the ratio of the period of time $T_{KR}$ within which the air/fuel ratio is richer than a median to the other period of time $T_{KL}$ within which the air/fuel ratio is a leaner than the median. In this case, $K_{FB}$ and $(K_{FB})_C$ are given as follows.

$$K_{FB}=(K_{FB})_C+\Delta K_{FB}$$

$$(K_{FB})_C=1.0+G_I\cdot\int \Delta V dQ$$

On the other hand, the relationship between the rich side rectangle width $T_{KR}$ and the lean side rectangular width $T_{KL}$ is given by $T_{KL}/T_{KL}=1.0+G_P\Delta V$. Thus, $$T_{KL}=T_K(1.0+G_P\Delta V)^{\frac{1}{2}}, \text{ and}$$

$$T_{KL}=T_K(1.0+G_P\Delta V)^{-\frac{1}{2}}.$$

$G_P$ and $G_I$ are mapped relative to Karman frequencies similarly to those described hereinabove, and the values of $\int \Delta V dQ$ and $K_{FB}$ as well as values of the rich side rectangle width $T_{KR}$ and the lean side rectangle width $T_{KL}$ are also updated (learned) for each of the operation zones of the engine.

Further, the magnitude $\Delta A$ may be mapped relative to Karman frequencies or reciprocals thereof even if it has a constant value (including the case wherein it has a constant value for the entire operation zone of the engine and the case wherein it has a constant value for each of plural operation zones of the engine).

When the ratio of the rich side time width $T_{KR}$ to the lean side time width $T_{KL}$ is changed as shown in FIG. 18 upon compulsory fluctuation, the responsibility in the transition period of the operation state of the engine changes can be compensated.

It is a matter of course that the method of changing and correcting the median and the magnitude of the air/fuel ratio, the cycle, the ratio of the rich side time width to the lean side time width and so forth in response to an output of the $O_2$ sensor 18 in such compulsory fluctuations can be applied irrespective of the waveform of the compulsory fluctuations (chopping waves, rectangular waves, sine waves, and so forth).

As the $O_2$ sensor 17, it is possible to use a conventional $O_2$ sensor with catalytic ability not improved, instead of an $O_2$ sensor in which its electrodes and/or a protective layer 17 coated on the exhaust-gas-side electrode 17*a* has been impregnated with a catalyst such as Pt/Rh to relatively improve the catalytic ability in the vicinity of the electrodes.

Further, as the $O_2$ sensors 17,18, it is possible to use full-range air/fuel ratio sensors whose output values continuously change in accordance with air/fuel ratios, instead of λ-type $O_2$ sensors whose outputs abruptly change near the theoretical air/fuel ratio.

As means for controlling the air/fuel ratio, various means may be employed, in addition to means using a solenoid valves, means employing an electronically controllable metering system associated with a carburetor (so-called electronically controlled carburetor), means having a device for feeding secondary air to an upstream side of the catalytic converter 9, or means for feeding air to the engine combustion chambers while bypassing a carburetor (secondary intake air feeding method).

What is claimed is:

1. An apparatus for controlling the air/fuel ratio of an internal combustion engine equipped with a catalytic converter disposed in an exhaust system, comprising:

a means disposed in the exhaust system for detecting components of exhaust gas;

a means for compulsorily changing the air/fuel ratio with a desired amplitude at a desired cycle;

a means for setting a first target value which gives a target air/fuel ratio to be compared with each output from said exhaust gas detection means; and a means for controlling the air/fuel ratio, which has been compulsorily changed by said air/fuel ratio changing means, on the basis of the result of a comparison between the output from said exhaust gas detection means and the first target value from said target value setting means, whereby the average air/fuel ratio may be controlled to the first target air/fuel ratio; and said first target value setting means having a means for modifying the first target value to a second target value, which gives a leaner air/fuel ratio, in a specific operation state of the internal combustion engine.

2. The apparatus of claim 1, wherein the first target air/fuel ratio is a stoichiometric air/fuel ratio.

3. The apparatus of claim 2, wherein the specific operation state is a low-load operation state.

4. The apparatus of claim 3, wherein the low-load operation state is a low-speed and low-load operation state.

5. The apparatus of claim 3, wherein the low-load operation state is an idling operation state.

6. The apparatus of claim 2, wherein the specific operation state is a small intake-air-quantity operation state.

7. The apparatus of claim 6, further comprising a means for detecting the quantity of intake air, whereby the internal combustion engine is judged to be in the small intake-air-quantity operation state when an output from said intake-air-quantity detection means falls below a predetermined value.

8. The apparatus of claim 7, wherein said intake-air-quantity detection means is a Karman sensor which outputs a pulse signal of a frequency based on Karman vortices of intake air and corresponding to information on the quantity of the intake air.

9. The apparatus of claim 1; wherein the compulsory change of the air/fuel ratio is effected by said air/fuel ratio changing means on the basis of results of a proportional-plus-integral operation for the difference between an output from said exhaust gas detection means and the first target value.

* * * * *

UNITED STATES PATENT AND TRADEMARK OFFICE

CERTIFICATE OF CORRECTION

PATENT NO. : 5,033,440

DATED : July 23, 1991

INVENTOR(S) : Shiro Kumagai; Yoshiaki Kodama; Nobuyuki Yasuda; Katsuyuki Maeda

It is certified that error appears in the above-identified patent and that said Letters Patent is hereby corrected as shown below:

On the title page

Assignees: Mitsubishi Jidosha Kogyo Kabushiki Kaisha, Tokyo, Japan; and Mitsubishi Jidosha Engineering Kabushiki Kaisha, Tokyo, Japan

Signed and Sealed this

Twenty-ninth Day of December, 1992

*Attest:*

DOUGLAS B. COMER

*Attesting Officer*

*Acting Commissioner of Patents and Trademarks*